United States Patent [19]

Reed, Jr. et al.

[11] 4,124,418

[45] Nov. 7, 1978

[54] SILOXANE-COATED AMMONIUM PERCHLORATE AND PROPELLANT COMPOSITIONS MADE THEREWITH

[75] Inventors: Russell Reed, Jr., Ridgecrest, Calif.; Robert E. Meyer, Ogden, Utah; Graham C. Shaw, Garland, Utah; Richard P. Cornia, Logan, Utah

[73] Assignee: Thiokol Corporation, Newtown, Pa.

[21] Appl. No.: 352,589

[22] Filed: Apr. 19, 1973

[51] Int. Cl.[2] ..... C06B 45/34

[52] U.S. Cl. ..... 149/7; 149/8; 149/19.4; 149/76

[58] Field of Search ..... 149/7, 8, 76

[56] References Cited

U.S. PATENT DOCUMENTS

| | | | |
|---|---|---|---|
| 3,092,526 | 6/1963 | Philipson | 149/76 X |
| 3,172,794 | 3/1965 | Ender | 149/76 X |
| 3,190,776 | 6/1965 | Ender | 149/7 X |
| 3,551,222 | 12/1970 | Kaufman et al. | 149/76 X |

*Primary Examiner*—Leland A. Sebastian

*Attorney, Agent, or Firm*—Stanley A. Marcus; William R. Wright, Jr.

[57] ABSTRACT

Ammonium perchlorate particles having strongly adherent wettable coatings are made by treating the particles with stong amines that displace ammonia to form amine perchlorates at the particle surfaces. Silanylamines are preferred since after amination of the perchlorate the silane groups can be hydrolyzed to siloxanes having good wettability by liquid polymeric propellant binders. The coated perchlorate can be used to produce solid propellants having improved mechanical properties and burning characteristics.

15 Claims, No Drawings

SILOXANE-COATED AMMONIUM PERCHLORATE AND PROPELLANT COMPOSITIONS MADE THEREWITH

This invention relates to coated ammonium perchlorate particles of a type adapted to be used in solid propellant compositions, as well as to a method of making the coated particles and propellant compositions containing the same.

Solid propellants for rocket motors commonly comprise a dispersion of a major amount of finely divided inorganic oxidizer in a minor amount of organic fuel-binder. The preferred oxidizer is generally ammonium perchlorate. The propellant compositions are made by mixing the ammonium perchlorate or other oxidizer with a liquid, curable organic polymer, a curing agent for the polymer and certain special purpose components, e.g., curing catalysts, burning rate modifiers and the like. The resulting mixture is introduced into a mold, and cured in situ, usually at an elevated temperature, to a solid propellant composition.

One problem encountered in the manufacture of such propellant compositions arises out of the fact that the relatively viscous liquid polymers used to form the fuel-binder do not readily wet the fine ammonium perchlorate particles, with the result that it is difficult to obtain a complete and uniform dispersion of the oxidizer particles in the liquid polymer. Incomplete dispersion of the oxidizer has an adverse effect on the mechanical properties of the propellant composition and also on its burning rate and burning rate exponent.

In U.S. Pat. No. 3,190,776, it is disclosed that the wetability of ammonium perchlorate particles by the liquid polymer can be improved by forming an organosiloxane coating on the particles. In accordance with the patented process ammonium perchlorate particles are mixed with a solution of an organohalosilane in a hydrocarbon solvent, after which the coated particles are separated from the solution, the residual solvent is evaporated and the particles are exposed to humid air to cause the halosilane at the surface of the particles to be converted to a siloxane.

While such a siloxane coating does improve the wetability of the ammonium perchlorate particles, it is subject to the disadvantage that it does not adhere adequately to the particle surfaces. During the mixing operation the surfaces of the particles are subjected to a certain amount of abrasion and at least a part of the siloxane coating is rubbed off. Moreover, the hydrocarbon solvent is partially soluble in the coating, which makes the solvent difficult to remove and also tends to reduce the adhesion of the siloxane coating.

It has also been proposed that ammonium perchlorate be mixed with very finely divided silica (Cabosil) as a means of forming a coating thereon having improved wetability. However, such coatings also abrade easily.

It is accordingly an object of the present invention to provide ammonium perchlorate particles having a coating thereon that is strongly adherent to the particles and also improves the wetability of the particles by the liquid polymer used to form the fuel-binder. It is another object of the invention to provide a novel process for making such coated particles. It is still another object of the invention to provide a propellant composition made from such coated particles and having improved mechanical properties and a relatively high burning rate. It is still another object of the invention to provide a propellant composition made from such coated particles and having a relatively high burning rate pressure exponent. It is still another object of the invention to provide ammonium perchlorate particles having a strongly adherent coating of a compound having a functional group capable of reacting with the fuel-binder and/or the curing agent used for curing the fuel-binder. Other objects of the invention will be in part obvious and in part pointed out hereafter.

The objects of the invention are achieved in general by utilizing as a coating agent a compound capable of forming a chemical bond with the ammonium perchlorate. More particularly, it has been found that a strongly adherent, readily wetable coating can be obtained by causing a strong amine to react with the surfaces of the ammonium perchlorate particles, preferably under the conditions described below. A strong amine as the term is used herein is an amine having a basicity such that it is capable of reacting with ammonium perchlorate to displace ammonia therefrom. Such amines include alkylamines, aminoalkylamines, hydroxyalkylamines, mercaptoalkylamines and aminoalkyl silanes. More particularly the amine may be a monoamine such as $RNH_2$, $R_2NH$ or $R_3N$ where R has 1 to 36 carbon atoms and may be alkyl, cycloalkyl alkenyl, aryl or aralkyl amines, e.g., methyl, ethyl, propyl, octyl, dodecyl, octadecyl, propylene, butylene, phenyl, ethylphenyl or benzyl; diamines such as $H_2N\text{-}R_1\text{-}NH_2$ wherein $R_1$ is an alkylene group of 4 to 36 carbon atoms, e.g., butylene diamine, hexylene diamine, dodecenyl diamine or a diamine derived dimer and wherein $R_1$ has 36 carbon atoms; polyamines, e.g., triethylene tetramine; hydroxyalkylamines having an alkyl group of 2 to 18 carbon atoms, e.g., ethanolamine, diethanolamine, N-methyl ethanolamine, 2-hydroxypropylamine, hydroxyethylstearylamine; mercaptoamines, e.g., mercaptoethylamine or mercaptopropylamine; amino, diamino or triamino trialkoxy silanes with alkyl, cycloalkyl or aralkyl groups between the silane group and the proximate amino group and between the amino groups in the case of the diamino or triamino derivatives, for example, $H_2NRNHR_1Si(OR_2)_3$ or $H_2NRSi(OR_2)_3$ wherein R and $R_1$ are defined as above and $R_2$ is an alkyl group of 1 to 4 carbon atoms. The preferred amino-trialkoxy silanes are aminoethyl trimethoxysilane, aminopropyl trimethoxysilane, carbethoxyaminoethyl trimethoxysilane or aminoethyl aminopropyl trimethoxysilane ($H_2N.CH_2CH_2.NH.CH_2CH_2CH_2Si(OCH_3)_3$).

The fuel-binder may be formed from any of a wide variety of liquid polymers which are curable to elastomeric form and which are known to be useful in solid propellants. Thus the liquid polymer forming the basis of the fuel-binder may be, for example, a linear polyester, a linear polyether, a carboxyl-terminated linear aliphatic hydrocarbon, a hydroxyl-terminated linear aliphatic hydrocarbon, a linear epoxy resin, a polyurethane prepolymer, a polythiopolymercaptan, a butadiene-acrylic acid copolymer, a butadiene-acrylonitrile copolymer, a polyacrylate, a polycarbonate, a fluorocarbon polymer or blends of such liquid polymers.

The carboxyl-terminated polyesters used as fuel-binders in the present compositions may be prepared in known manner by condensing dicarboxylic acids with diols under temperature and pressure conditions known in the art. Typical dicarboxylic acids useful in preparing the polyesters include succinic, adipic, sebacic, maleic and fumaric acids and others, as well as mixtures of these acids. The diols used may include ethylene glycol, diethylene glycol, triethylene glycol, propylene glycol, polybutylene and polypropylene glycols and block copolymers of ethylene and propylene glycols, alkane diols, castor oil and the like. Minor amounts of polybasic acids such as itaconic and polyhydric alcohols such as glycerols, sorbitols and pentaerythritol may be included in the reaction mixture. The liquid polyesters preferably have a molecular weight of 500 to 5000.

The carboxyl-terminated aliphatic hydrocarbons may be carboxyl-terminated butadiene polymers prepared as described in Berenbaum U.S. Pat. No. 3,235,589 and may have a molecular weight within the range 500 to 10,000. The carboxyl-terminated acrylobutadiene copolymers may be prepared as disclosed in Lowrey et al. U.S. Pat. No. 3,595,717 and may have molecular weights within the range 1000 to 7000. The liquid polyurethane prepolymers may be prepared in known manner by reacting diisocyanates with hydroxyl-terminated polyesters or polyethers, or known commercial types of liquid polyurethane polymers may be used having molecular weights of say 1000 to 10,000. The liquid polythiopolymercaptans may be prepared as disclosed in U.S. Pat. No. 2,466,963 and may have molecular weights in the range 1000 to 5000. The liquid hydroxyl-terminated hydrocarbon polymers may be prepared as disclosed in U.S. Pat. No. 3,427,366.

The fluorocarbon polymer may be a solution of vinylidene fluoride-hexafluoropropylene copolymer (Viton A) in a fluoroalkylacrylate, e.g., $CH_2{=}CHCO_2(CF_2)_nCHF_2$ wherein $n$ = 1, 3, 5 or 7 such as trihydrododecafluoroheptyl acrylate where $n$ = 5; or a poly-perfluoroether with a hydroxyl functionality of 2 and a molecular weight of about 2000. The first type of fluorocarbon polymer can be cured by the addition of a free-radical catalyst such as benzoyl peroxide or ditertiary-butyl peroxide and heating to 80° to 170° F. The hydroxyl-terminated polymer can be cured in the usual manner with diisocyanates, e.g., methyl 2,6-diisocyanatohexanoate $$(OCNCH_2CH_2CH_2CH_2\underset{\underset{NCO}{|}}{C}{-}CO_2CH_3).$$

The liquid prepolymers used as fuel-binders are cured according to curing techniques well known in the resin art using polymerization catalysts, curing agents or accelerators commonly used. For example, the polyesters may be cured at temperatures ranging from 80° to 180° F. using the usual curing agents such as polyepoxides, polyamines and the like. Similarly the polyurethane prepolymers can be cured at temperatures varying between ambient and 250° F. when treated with curing agents such as polyols. The carboxyl-terminated hydrocarbon polymers and acrylobutadiene copolymers such as the acrylic acid butadiene copolymers can be conveniently cured with polyepoxides, e.g., trifunctional epoxide resins based on p-amino-phenol, in known manner. Small amounts of curing catalysts of the metal salt type, e.g., iron, chromium, or stannous salts of linoleic or 2-ethylhexanoic acid may be used in conjunction with the polyepoxide curing agent. The liquid polythiopolymercaptans can be cured with various oxidizing agents as disclosed in U.S. Pat. No. 2,466,963.

The preferred amines from the standpoint of improving the wetability of the coated particles are the aminoalkyl silanes. In accordance with a preferred embodiment of the process of the present invention, a small amount, say 1% to 8% by weight, of the aminoalkylsilane is dissolved in a halocarbon solvent, e.g., one of the Freons, preferably Freon 113 ($CCl_2FCClF_2$) or alternatively Freon 11 ($CFCl_3$). The type of halocarbon solvent used can be used to control or limit the reaction temperature and therefore the reaction rate. The particulate ammonium perchlorate is mixed with the solution at ambient temperature or a moderately elevated temperature, say 50° to 150° F.

As indicated above, the amine group of the silane reacts with the ammonium perchlorate to evolve ammonia and form a chemical bond between the alkylsilane and the ammonium perchlorate. The silane group is converted to a siloxane either concurrently with or subsequent to the reaction between the aminoalkylsilane and the ammonium perchlorate. Hydrolysis of the silane groups to siloxanes may be effected in any of several ways, such as by adding a small amount of water to the reaction mixture or passing an inert gas containing water vapor through the reaction mixture or simply exposing the coated particles to atmospheric air for a sufficient period of time to convert the silane groups to siloxane groups.

The addition of water to the reaction vessel containing the Freon has the advantage of causing the silane condensation to the siloxane to occur in a stirred slurry where lumping and agglomeration can be minimized resulting in the recovery of over 86% of the ammonium perchlorate as fine silanated product and less than 3% of the material as larger than 24-mesh. The time at which the water is added to the reactor has an observable effect upon the strength of the agglomerated particles of ammonium perchlorate. The addition of water at the start of the reaction or to the Freon before the ammonium perchlorate is added to the reaction mixture results in friable agglomerates which are more easily broken up than those resulting from reactions in which the water is added after the start of the reaction.

When the reaction between the aminoalkylsilane and the ammonium perchlorate has been completed, the coated ammonium perchlorate particles are separated from the solution by filtration or centrifuging and the coated particles are heated to remove residual halocarbon solvent. The use of the halocarbon solvent is advantageous since it does not dissolve in the coating as do the hydrocarbon solvents and therefore can be more readily removed from the coated particles; moreover the hydrocarbon solvent is a potential hazard in the presence of an oxidizing agent such as ammonium perchlorate. The product obtained upon evaporation of the solvent is a free-flowing powder having good wetability and capable of being used to produce propellants having improved properties as indicated in the Examples given below. These improved properties include improved processing and burning rate control, better ageing properties, improved extinction properties and increased specific impulse efficiency.

While the aminoalkylsilanes are preferred for improving the wetability of the ammonium perchlorate particles, the bifunctional amines described above, i.e., the hydroxyalkyl amines, mercaptoalkyl amines and diamines have a special advantage in that they not only react with the ammonium perchlorate to form a coating having improved wetting properties, but also have a second functional group capable of reacting with the functional groups of commonly used fuel-binders and/or curing agents. For example, the hydroxy, mercapto and amino groups of the difunctional amines may be reacted with the carboxyl and hydroxyl groups of the carboxyl- and hydroxyl-terminated hydrocarbon polymers of the type described above, as well as with the epoxides and amines used to cure such polymers. Thus the propellant compositions made with ammonium perchlorate coated with such difunctional amines have especially good physical properties.

The quantity of amine or aminosilane used is a function of the surface area of the ammonium perchlorate particles and the molecular weight of the amino compound. More particularly, for a given weight of ammonium perchlorate a larger amount of a given amino compound is desirably used for a relatively small particle size ammonium perchlorate and vice versa. In most cases satisfactory results are obtained using from 0.005 to 0.1 mols of the amino compound per mol of ammonium perchlorate. The preferred amount is about 0.02 mols of amino compound per mol of ammonium perchlorate.

In order to point out more fully the nature of the present invention, the following specific Examples are given of illustrative methods of preparing coated ammonium perchlorate particles in accordance with the invention and incorporating such coated particles in propellant compositions.

EXAMPLE 1

A reactor was charged with 1200 ml. of Freon 113, 450 grams of ammonium perchlorate and then 15.25 grams of trimethoxysilylpropylethylene diamine (Dow Corning ZC 6020) added over a 30 second period while stirring the slurry at ambient temperature. A flow of nitrogen was used to remove the ammonia formed in the reaction. After 10 minutes reaction time 2.8 ml. of $H_2O$ (50% excess of the required theoretical amount) was added. The excess water forced the condensation reaction of the silane rapidly to completion to form the siloxane coating in the reactor, and filtration of the coated ammonium perchlorate after 23 minutes total reaction time gave a free-flowing product.

EXAMPLE 2

A reactor was charged with about 100 lbs. Freon 113 and 1230 grams of the silane of Example 1. The mixture was stirred and 80 lbs. of ammonium perchlorate were added rapidly to the reaction mixture. After 15 minutes reaction time, 112 ml. of water (75% of theoretical) was added and the reaction continued for a total of 45 minutes. The filtered product had a tacky appearance due to the presence of part of the silane in the silanol form. Drying 20 hrs. at 150° to 170° F. with a nitrogen purge gave a free-flowing product.

EXAMPLE 3

A reactor was charged with 450 grams of ammonium perchlorate and 1200 ml. of Freon 113, then 2.8 ml. of water was added with stirring. 15.25 grams of the silane of Example 1 was added to the stirred mixture and the ammonia formed was removed with a nitrogen purge. After 48 minutes reaction time the ammonium perchlorate was filtered and air dried. The product, which had a starting average particle size of 45 microns, ended up as soft or friable agglomerates over 200 microns in size. The material was screened through a 100-mesh screen giving an average particle size of 96 microns.

EXAMPLE 4

To 450 grams of ammonium perchlorate and 1200 ml. of Freon 113 in a stirred reactor was added 15.25 grams of the silane of Example 1 and then after 10 minutes reaction time, 1.4 ml. of water. After 12 to 13 minutes further reaction time ethylene oxide was bubbled into the reactor. After one hour total reaction time the product was filtered and air dried. A free-flowing material was obtained which had no tendency to lump or further agglomerate after the reaction. Thus the addition of ethylene oxide resulted in a product with improved mechanical properties.

EXAMPLE 5

In this Example a small amount of halosilane was added to increase the silane content of the product and to decrease the content of unreacted amine. A reactor was charged with 450 grams of ammonium perchlorate, 1200 ml. of Freon 113, and 15.25 grams of the silane of Example 1. A nitrogen purge was used to remove the ammonia formed. After 44 minutes reaction time 4 ml. of silicon tetrachloride was added, followed 6 minutes later by the addition of 5.6 ml. of water. After 1 hr. reaction time the product was filtered and air dried, giving a free-flowing product.

EXAMPLE 6

450 grams of ammonium perchlorate was added to a stirred solution of 1,6-hexanediamine, in 1500 ml. of Freon 112 (difluorotetrachloroethane) at 100°–190° F. to form a solution containing 1-2% by weight of the diamine based on the weight of ammonium perchlorate. Ammonia was evolved and an amine perchlorate was formed on the surface of the ammonium perchlorate particles. The Freon was removed by centrifuging and the product dried in a jacketed double cone drier at 75°–150° F. at 14 mm. absolute pressure to yield a colorless, free-flowing product.

EXAMPLE 7

Coated ammonium perchlorate as prepared in Example 1 was incorporated in a solid propellant and its mechanical and burning properties compared with those of a similar propellant made with uncoated ammonium perchlorate and a propellant made with silica-coated ammonium perchlorate. The liquid polymer used for the fuel-binder was a liquid polyurethane prepolymer (Adiprene L-420) which was the reaction product of polytetramethylene glycol and tolylene diisocyanate. This prepolymer had a molecular weight of about 3000 and was cured with a mixture of trimethylolpropane, 1,4-butanediol and castor oil in approximately stoichiometrical amounts. In each case a mixture of 200 micron and 47 micron particle size ammonium perchlorate was used. The composition of the propellants and the measured properties are given in Table 1 below where the proportions of the components are in percent by weight. The coated ammonium perchlorate of Example 1 contained about 0.5% silica as siloxane.

Table 1

| | A | B | C | D |
|---|---|---|---|---|
| Polyurethane Binder | 23.00 | 23.00 | 23.00 | 23.00 |
| Aluminum Powder | 15.00 | 15.00 | 15.00 | 15.00 |
| Silanated ammonium perchlorate (200 micron) | — | — | — | 24.80 |
| Silanated ammonium perchlorate (47 micron) | — | — | — | 37.20 |
| Uncoated ammonium perchlorate | | | | |

Table 1-continued

| | | | | |
|---|---|---|---|---|
| (200 micron) | 24.80 | 24.30 | 23.80 | — |
| Uncoated ammonium perchlorate (47 micron) | 37.20 | 37.20 | 37.20 | — |
| Silica (Cab-O-Sil, Cabot Corp.) | — | 0.50 | 1.00 | — |
| $P_{dl}$(psia) (Pressure at which burning ceases, known as the pressure deflagration limit.) | 43 | 47 | 52 | 52 |
| n (Burning rate pressure exponent) | 0.22 | 0.42 | 0.53 | 0.65 |
| | Mechanical Properties at 80° F. | | | |
| $E^{2.6}$ (modulus, p.s.i.) | 815 | 628 | 522 | 726 |
| $\sigma_m$ (maximum stress, p.s.i.) | 102 | 88 | 73 | 118 |
| $\epsilon^t_{m+}$ (% strain at maximum stress) | 30 | 35 | 43 | 100 |
| $\epsilon^t_R$ (% strain at rupture) | 100 | 100 | 100 | 100 |
| | A | B | C | D |
| | Mechanical Properties at −25° F. | | | |
| $E^{2.6}$ (modulus, p.s.i.) | 61000 | 35000 | 62000 | 19000 |
| $\sigma_m$ (maximum stress, p.s.i.) | 1223 | 1220 | 1570 | 944 |
| $\epsilon^t_{m+}$ (% strain at maximum stress) | 3 | 4 | 3 | 14 |
| $\epsilon^t_R$ (% strain at rupture) | 3 | 4 | 3 | 21 |

The data of the foregoing Table show that the siloxanated ammonium perchlorate (Sample D) increased the burning rate slope "*n*", in comparison with uncoated ammonium perchlorate (Sample A) by 195%, whereas the silicon-coated product containing the same amount of silica increased the value of "*n*" by only 90%. This indicates that the siloxanated ammonium perchlorate was more than twice as efficient in raising the value of "*n*" as the Cab-O-Sil and was 55% more efficient than Sample C which contained twice the amount of silica. The data also show the improved mechanical properties of Sample D.

It is, of course, to be understood that the foregoing Examples are intended to be illustrative only and that numerous changes can be made in the ingredients, proportions and conditions disclosed without departing from the spirit of the invention as defined in the appended claims.

We claim:

1. Finely divided ammonium perchlorate, the particles of which are coated with a strongly adherent coating consisting essentially of a perchlorate of an amine selected from alkylamines, aminoalkylamines, hydroxyalkylamines, mercaptoalkylamines and silanylalkylamines.

2. Finely divided ammonium perchlorate according to claim 1 wherein the coating on the particles consists essentially of an aminoalkylamine perchlorate.

3. Finely divided ammonium perchlorate according to claim 1 wherein the coating on the particles consists essentially of a hydroxyalkylamine perchlorate.

4. Finely divided ammonium perchlorate according to claim 1 wherein the coating on the particles consists essentially of a siloxyalkylamine perchlorate.

5. Finely divided ammonium perchlorate according to claim 1 wherein the coating on the particles consists essentially of an alkylamine perchlorate.

6. A method of making coated particles of ammonium perchlorate which comprises reacting finely divided ammonium perchlorate particles with a strong amine capable of displacing ammonia from said ammonium perchlorate to produce a coating of amine perchlorate on the surface of said particles.

7. A method according to claim 6 wherein said amine is selected from alkylamines, aminoalkylamines, hydroxylalkylamines, mercaptoalkylamines and silanylalkylamines.

8. A method according to claim 7 wherein said reaction is carried out at a temperature of 50° to 150° F.

9. A method of making coated particles of ammonium perchlorate which comprises mixing finely divided particles of ammonium perchlorate with a solution in a halocarbon solvent of an amine selected from alkylamines, aminoalkylamines, hydroxyalkylamines, mercaptoalkylamines and silanylalkylamines to cause said amine to react with said ammonium perchlorate to form a coating of the perchlorate of said amine on the surfaces of said particles, separating said coated particles from said solution, and evaporating residual solvent from said particles to form a free-flowing powder.

10. A method according to claim 9 wherein said amine is a silanylalkylamine and water is added to the reaction mixture to form a siloxylamine perchlorate coating on said particles.

11. A solid propellant composition comprising a major amount of finely divided ammonium perchlorate particles dispersed in a minor amount of a polymeric elastomeric fuel-binder, said particles being coated with a thin layer of a perchlorate of an amine selected from alkylamines, aminoalkylamines, hydroxyalkylamines, mercaptoalkylamines and silanylalkylamines.

12. A solid propellant according to claim 11 wherein the ammonium perchlorate particles are coated with a siloxanated amine perchlorate.

13. Finely divided ammonium perchlorate, the particles of which are coated with a strongly adherent coating consisting essentially of an amine perchlorate, said coated particles having been made by the method of claim 9.

14. Finely divided coated ammonium perchlorate particles as described in claim 1 wherein the amine perchlorate is a perchlorate of silylpropyl-ethylenediamine.

15. Finely divided coated ammonium perchlorate particles as described in claim 1 wherein the amine perchlorate is a perchlorate of 1,6-hexanediamine.

* * * * *